US009688455B2

(12) United States Patent
Nehring

(10) Patent No.: US 9,688,455 B2
(45) Date of Patent: Jun. 27, 2017

(54) MODULAR INSULATED CONTAINER AND METHOD FOR OPERATING SAME

(71) Applicant: DELTA T GESELLSCHAFT FÜR MEDIZINTECHNIK MBH, Fernwald (DE)

(72) Inventor: Dirk Nehring, Marburg (DE)

(73) Assignee: DELTA T GESELLSCHAFT FUER MEDIZINTECHNIK MBH, Fernwald (DE)

( * ) Notice: Subject to any disclaimer, the term of this patent is extended or adjusted under 35 U.S.C. 154(b) by 18 days.

(21) Appl. No.: 14/443,291

(22) PCT Filed: Aug. 21, 2013

(86) PCT No.: PCT/IB2013/056779
§ 371 (c)(1),
(2) Date: May 15, 2015

(87) PCT Pub. No.: WO2014/076586
PCT Pub. Date: May 22, 2014

(65) Prior Publication Data

US 2015/0284169 A1 Oct. 8, 2015

(30) Foreign Application Priority Data

Nov. 16, 2012 (DE) ..... 10 2012 022 398

(51) Int. Cl.
*B65D 81/38* (2006.01)
*B65D 19/18* (2006.01)
(Continued)

(52) U.S. Cl.
CPC ..... *B65D 81/3823* (2013.01); *B65D 19/18* (2013.01); *B65D 19/38* (2013.01);
(Continued)

(58) Field of Classification Search
CPC ..... B65D 81/3823; B65D 81/3816; B65D 81/18; B65D 19/18; B65D 2519/00184;
(Continued)

(56) References Cited

U.S. PATENT DOCUMENTS 2,904,682 A * 9/1959 Rawlins ..... G08C 15/04 324/76.31
5,669,233 A 9/1997 Cook et al.
(Continued)

FOREIGN PATENT DOCUMENTS

EP 2 053 325 4/2009
FR 2 974 353 10/2012
(Continued)

OTHER PUBLICATIONS

International Search Report mailed on Mar. 19, 2014 in corresponding International Patent Application No. PCT/IB2013/056779.

*Primary Examiner* — Mohammad M Ali
(74) *Attorney, Agent, or Firm* — Klaus J. Bach

(57) ABSTRACT

A modular insulated container for storing goods at constant temperatures. The container has, in an outwardly insulating manner, at least one base, at least one cover and at least four side walls of insulating material, which enclose an inner chamber provided for accommodating the goods in a thermally insulating manner. The at least four side walls are mounted separately with the at least one base and the at least one cover. At least one of the mounted, outwardly insulating side walls has temperature control elements, which face the inner chamber and contain thermal storage fluids, which are separated from the inner chamber by thermally conductive material.

19 Claims, 10 Drawing Sheets

(51) Int. Cl.
*B65D 81/18* (2006.01)
*B65D 19/38* (2006.01)

(52) U.S. Cl.
CPC ..... *B65D 81/18* (2013.01); *B65D 81/3816* (2013.01); *B65D 2203/10* (2013.01); *B65D 2519/00044* (2013.01); *B65D 2519/00069* (2013.01); *B65D 2519/00184* (2013.01); *B65D 2519/00218* (2013.01); *B65D 2519/00273* (2013.01); *B65D 2519/00293* (2013.01); *B65D 2519/00318* (2013.01); *B65D 2519/00338* (2013.01); *B65D 2519/00502* (2013.01); *B65D 2519/00587* (2013.01); *B65D 2519/00641* (2013.01); *B65D 2519/00711* (2013.01); *F25D 2303/083* (2013.01)

(58) Field of Classification Search
CPC ..... B65D 2519/00218; B65D 2519/00318; B65D 2519/00502; B65D 2519/00587; B65D 2519/00641; B65D 2519/00711; B65D 19/38; B65D 2203/10; B65D 2519/00044; B65D 2519/00069; B65D 2519/00293; B65D 2519/00338; B65D 2303/083
USPC ..... 62/457.4; 220/592.25, 592.2, 592.26
See application file for complete search history.

(56) References Cited

U.S. PATENT DOCUMENTS

| | | | | |
|---|---|---|---|---|
| 6,058,735 | A | 5/2000 | Nathan | |
| 6,237,795 | B1 * | 5/2001 | Buckley | B65D 19/44 206/386 |
| 2010/0075082 | A1 * | 3/2010 | Komada | B32B 27/00 428/35.7 |
| 2011/0049164 | A1 * | 3/2011 | Banks | B65D 19/02 220/592.01 |
| 2014/0091098 | A1 | 4/2014 | Casoli | |

FOREIGN PATENT DOCUMENTS

| | | | |
|---|---|---|---|
| WO | WO 2005/007519 | A2 | 1/2005 |
| WO | WO 2006/082433 | A1 | 8/2006 |
| WO | WO 2009/035661 | A1 | 3/2009 |
| WO | WO 2012/143409 | A1 | 10/2012 |

* cited by examiner

MODULAR INSULATED CONTAINER AND METHOD FOR OPERATING SAME

CROSS-REFERENCE TO RELATED APPLICATIONS

This application is a U.S. National Stage Application, which claims the benefit under 35 U.S.C. §371 of PCT International Patent Application No. PCT/IB2013/056779, filed Aug. 21, 2013, which is based on and claims the foreign priority benefit under 35 U.S.C. §119, of German Patent Application No. 10 2012 022 398.6, filed Nov. 16, 2012, the contents of which are incorporated herein by reference.

FIELD OF THE INVENTION

The invention is related to a modular insulated container for storing goods at constant temperatures with the features of the preamble of claim 1. The invention also relates to a method for operating a modular insulated container.

BACKGROUND OF THE INVENTION

During transport of drugs for periods of 24 hours, 48 hours, 72 hours, 96 hours or 120 hours it is necessary to maintain the temperature ranges, as stipulated by the producer of the drug or corresponding authorities, for storage and distribution to provide for usability and the safety of the drugs.

Thus temperature ranges of 2 to 25° C., 15 to 25° C. and 2 to 8° C. are stipulated for many drugs as conditions for storage and transport and are indicated as well on the packaging and package insert. Insulating packages are frequently used in order to guarantee permanently compliance of the temperature range during transport onshore, at sea and in the air. These packages are most of the time for the 2 to 8° C. range provided with appropriate cooling elements or with active cooling technique. Cooling elements respectively pre-temperate for a predefined temperature range are problematic to use if ambient temperatures, e. g. in winter, differ from the forecast. This results for example in a risk that the temperature of the transported products, e. g. the drugs, supposed to be stored at 2 to 8° C. in most of the cases, sinks below 0° C. and the drug is frozen. Many drugs lose at once their properties after freezing or they may even be harmful for the health of patients.

The document DE 20 2006 017 869 U discloses an insulating box with a heat insulating cover and a heat insulated recipient housing an interior provided with at least one temperature control element for maintenance of temperatures. By configuration of numbers and positions of the temperature control elements it is possible to transport all common package sizes of different blood products in this insulating box of the state of the art at definable stable temperatures, said insulating box being appropriate for cooling as well as for heating of blood products during a transport by means of temperature control elements with different latent heat-storages with high heat- or cold-storage capacity for the ranges of 2° C. to 6° C. for erythrocytes, 20° C. to 24° C. for thrombocytes and full blood and of −30° C. to −40° C. for frozen fresh plasma. Depending on the necessary transport-time respectively different numbers of temperature control elements are added into the insulating box. These temperature control elements are most of the time positioned in the interior of the box at positions provided for this purpose. These elements stabilize by their phase transition from solid to liquid or from liquid to solid the inner temperature till the entire aggregation state has changed and the energy for crystallization are consumed. Temperature control elements, such as coolant members are inserted after or during the setup of the package in cavities provided therefor after e. g. pre-cooling of corresponding coolant members. Depending on size and construction of the package the insertion and addition of temperature control elements are cumbersome and time-consuming and possibly defective.

The document DE 100 30 102 A1 discloses a constant temperature transport system for goods, particularly for the transport of blood and drug-products. A storage-, protection- and transport container for perishable products has a double-wall filled with a liquid or solid latent heat-storage. The double-wall provides at the same time an insulating effect. Two similar cells of the transport container may be connected by a couple of snap connectors along the longitudinal sides. Thus a cavity protected mechanically from outer impact is provided between the two containers allowing storage of blood products.

The document EP 1 302 410 A1 discloses as well a system for transporting goods at constant temperature with a double-wall filled inside with a liquid or solid latent heat-storage providing at the same time an insulating effect. The transport container is made of two complementary, respectively double-wall cells and an equally complementary double-wall ring that may be connected by snap connectors along the longitudinal sides. The complementary double-wall ring provided with snap connectors allows enlargement of the inner cavity to be sheathed. The two complementary, respectively double-wall cells provide bottom and cover. The double-wall ring is also filled with a liquid operating as temperature storage and allowing high transfer or absorption of energy during phase change.

The document EP-A 1 006 058 discloses a container for temperature sensible goods with a temperature moderator maintaining the temperature sensible goods at constant intervals of temperature. A first phase change of the temperature moderator is effected at a minimal temperature and a second phase change at a maximal temperature to maintain the temperature sensible goods inside the temperature range. The temperature moderator is in a container for the temperature sensible goods.

The document WO 2009/035661 A1 discloses an insulated container with a bottom wall, a top wall and side walls defining a cavity for a plurality of coolant members positioned in the cavity.

The document U.S. Pat. No. 5,669,233 A discloses a collapsible and reusable shipping container with a series of inner insulated panels and an outer enclosure. The inner insulated panels possess a series of parallel channels, both horizontally configured along the bottom panel and vertically around the side panels, said panels retaining a plurality of heat sinks. A bottom enclosure and bottom panel is in operative communication with the side panels and outer enclosure, the assemblage retained in a closed condition by a top inner panel and top enclosure. The heat sinks cooperate to maintain constant interior temperatures, while a pallet means allows the packed container to be moved and stored.

SUMMARY OF THE INVENTION

It is an object of the invention to provide a modular insulated container for more simple, accelerated and safer logistics for transports of e. g. blood and medical products at defined stable temperatures. A further object of the invention is to provide a modular insulated container guaranteeing that its availability respectively its safe pre-cooling can be visualized. A still further object of the invention is to provide a method for operating a modular insulated container.

The solution is provided with a modular insulated container with the features of claim 1 of the invention. A further solution is provided with a method for operating a modular insulated container with the features of claim 12 of the invention. Advantageous embodiments of the invention are presented in the subclaims.

According to the invention a system for transporting goods at constant intervals of temperature, particularly for blood and medical products comprises a storage-, safety and transport-container for easily perishing products with a double-wall being filled from inside with a liquid or solid latent heat storage and providing an isolating effect additionally.

According to a preferred embodiment of the invention a modular insulated container for storing goods at constant temperatures, preferably for storing complete pallets loaded with drug boxes, e. g. Euro-pallets or US-pallets, is provided with at least one insulating base, at least one insulating cover and at least four insulating side walls consisting of insulating material, which enclose an inner chamber provided for accommodating the goods. The four insulating side walls can each be mounted separately with the base and/or the cover. At least one of the insulating side walls has in each case temperature control elements, which face the inner chamber and contain thermal storage fluids, which are separated from the inner chamber by means of thermally conductive material. The inventive modular insulated container allows pre-tempering automatically under ambient temperature conditions in a storage or a storage section by means of integration of the thermal storage fluid into the temperature control elements at the inside of the side walls, the enclosure of the thermal storage fluids in thermally conductive material allowing fast heat transfer through the inner side. The insertion of separately pre-cooled temperature control elements as disclosed in the state of the art is completely dispensable with the inventive modular insulated container and thus by means of the invention the cumbersome steps of supplying coolant members can be avoided. According to the invention at least one of the six walls is provided with integrated thermal storage fluid. The inventive modular insulated container is adapted for the distribution of drugs to be maintained at a temperature between 2 to 25° C. or 15 to 25° C. or 2 to 8° C. The inventive modular insulated container is adapted for storing of complete pallets, e. g. Euro-pallets or US-pallets loaded with drug boxes.

According to a further preferred embodiment of the invention the insulating material contains expanded polystyrene, expanded polypropylene or polyurethane hard foam.

According to a still further preferred embodiment of the invention the walls are between 60 and 200 mm thick.

According to a still further preferred embodiment of the invention the side walls are rectangular and provided with a tongue and groove system for a good and simple coupling of the separate insulating side walls respectively to each other and with the base and/or the cover. The side walls are shaped in a way to allow the same parts for the base and the cover and the side walls.

According to a still further preferred embodiment of the invention the base is shaped like a Euro-pallet for standard transport of the inventive modular insulated container by means of a stacker or according to a further embodiment of the invention the base is adapted to allow passage underneath it by means of a jack lift.

According to a still further preferred embodiment of the invention the thermally conductive material is provided as high barrier film made of polyethylenterephthalat (PET), polyethylene (PE) and aluminium. The high barrier film serves two purposes: First it encloses the temperature control element(s) like a barrier thus preventing drainage of the temperature control elements. Second the high barrier film transfers the thermal power of the temperature control elements with the specific high heat conductance value of the film. The special use of the high barrier film according to the invention is particularly advantageous with the combination of two purposes.

According to a still further preferred embodiment of the invention the high barrier film is provided as a transparent high barrier film bag made of PET and PE, of polyamide (PA) and/or PE with a further high barrier layer of ethylenvinylalcool (EVOH) and/or barrier films of PET coated with polyvinylidenchloride (PETX (PVDC)), OPPX, PETXP, PAX, (PA-EVOH-PA) and/or oriented polyamide (OPA), e. g. with a window or transparent plastic film, allowing easy, fast and visual detection of the aggregate state of the thermal storage fluid and subsequently its disposition for operation in the temperature control elements after distribution and transport. For example PA/PE has a very high intrinsic barrier allowing dispense of a further high barrier film such as EVOH, even though such film bags are applied for special uses.

According to a still further preferred embodiment of the invention the PET high barrier film bags are aluminium coated or provided as polyethylene plastic sheaths and adhered to the insulating side-walls or fixed with connecting-type components.

According to a still further preferred embodiment of the invention the PET high barrier film bags are flat between 1 mm and 30 mm and provide at least 60% coverage of the surface of the product space or the surface of the usable volume in order to provide as possible evenly stable inner temperatures in the inner volume of the inventive modular insulated container. 1 to 1000 high barrier film bags are foreseen for each side-wall.

According to a still further preferred embodiment of the invention the thermal storage fluid is pure n-paraffin, C16, C17 or C18, n-paraffin mix of C16, C17 and/or C18, pure tetradecan C14, tetradecan/pentadecan mix of C14 and C15, pure pentadecan, n-paraffin mix of C10 to C18, water, eutectic salt solutions, water salt mixes saturated NaCl—salt solution, saturated salt solution of ammonium hydrate or 2,3-butandiol. The thermal storage fluid is storage for the thermal energy and mounted to the inner side of the insulating side-walls in a way to allow faster cold or heat exchange to the inner volume of the container.

According to a still further preferred embodiment of the invention the container is provided with detection and recording means for temperature, pressure and vibration, particularly liquid crystal thermometers for display and/or temperature data logger. Preferably the detection and recording means are provided with radio transmission means for detected and recorded data, e. g. via mobile communications networks, internet and/or via a RFID read and write terminal.

According to a still further preferred embodiment of the invention the cover or one of the side-walls is provided with an identification label such as a barcode or a RFID-label.

According to a still further preferred embodiment of the invention an electronic, active or passive memory unit is provided allowing storage, transmission, amendment and transfer of an electronic way bill.

According to a still further preferred embodiment of the invention heat insulating panels are provided which are arranged respectively at the side oriented towards the inside of the at least one base and the at least four side-walls and in the cover in such a way as to define by means of the panel a thermally not entirely closed, fragmentary insulating body. A towards the inner volume perforated cover member is further provided with at least one cavity and at least one temperature control element between this cover member and heat insulating panel in the cover. The heat insulating panels have respectively a by one half reduced heat conductivity relative to the supporting insulating material of the side-walls. The heat insulating panels particularly have respectively a heat conductivity of less than 0.02 W/(m×K) and preferably as vacuum insulating panels a heat conductivity of less than 0.006 W/(m×K). Temperature control elements oriented towards the inner volume with heat storage fluids are separated from the inner volume by means of paperboard, transparent film or hose bag film as heat conductive material, e. g. made of preferably multi-layered PET-film or PE-film, said film or hose bag film of a material thickness of 5-150 μm being metal coated for improved heat conductivity, said improved heat conductivity resulting from the respectively known material parameters for paperboard, transparent film or hose bag film and its material thicknesses. For at least part transparency the metal coating is provided with windows to allow control of the aggregate state of the thermal storage fluid in the temperature control elements through the metal coated film or hose bag film.

According to a still further preferred embodiment of the invention cavities are provided for storing of the heat insulating panels respectively at the side oriented towards the inside of the at least one base and the at least four side-walls. Preferably the substantially rectangular cavities are respectively enclosed like in frames by fillets oriented towards the inner volume, said fillets being large between 5 and 50 mm parallel to the plane of the cavities such that after assembly between base and each of the at least four side-walls the heat insulating panels enclosed in the cavities along the edges between base and each of the at least four side-walls have respectively a distance of at least 10 mm and at most 100 mm from each other. The panels defining a thermally not entirely closed, fragmentary insulating body in the inner volume of the modular insulating container allow in combination with the insulating side-walls, base and cover an entire insulation characteristic of the modular insulating container allowing the use of water based temperature control elements. Water based temperature control elements offer particular cost advantages and particularly high melt enthalpy, such that the use of thermally not entirely closed, fragmentary insulating panels in combination with the use of water based temperature control elements allows particularly advantageous modular insulating containers.

According to a still further preferred embodiment of the invention the at least one heat insulating panel above the at least one temperature control element on the towards the inner volume perforated cover member is provided with a protection layer oriented outside against mechanic action or a protection layer against mechanic action is provided, which is laid on the at least one heat insulating panel above the at least one temperature control element on the cover member. The protection layer protects particularly evacuated heat insulating panels from mechanic destruction, drainage of vacuum, i. e. intrusion of air.

According to a still further preferred embodiment of the invention the at least one temperature control element on the cover member is water-based, i. e. as thermal storage fluid are provided eutectic salt solutions, water salt mixes saturated NaCl—salt solution, saturated salt solution of ammonium hydrate or 2,3-butandiol.

According to a still further preferred embodiment of the invention the at least one temperature control element are welded with transparent film or hose bag film for improved and/or faster handling at operation. The transparent film or hose bag film may be metal coated.

According to a still further preferred embodiment of the invention a method for operating a modular insulating container comprises essentially the following steps:

Providing first of all separately at least one insulating base, at least one insulating cover and at least four separate insulating side walls consisting of insulating material, said at least one insulating base, said at least one insulating cover and said at least four separate insulating side walls being adapted respectively for insulation from outside for heat tight accommodation of goods in an inner volume of the inventive modular insulating container. The at least one insulating base and/or the at least one insulating cover and/or one of the at least four separate insulating side walls have temperature control elements, which face the inner volume and contain thermal storage fluids, which are separated from the inner volume by means of thermally conductive material. The temperature control elements are pre-tempered and visually controlled whether or not the thermal storage fluid in the temperature control elements have transited in the foreseen aggregate state from liquid to solid or vice versa. The at least one insulating base is loaded with goods at constant temperatures, preferably with complete pallets loaded with drug boxes, e. g. Euro-pallets or US-pallets. The at least four separate insulating side walls and the cover are mounted on the at least one insulating base to the inner volume closed heat tight towards the outside of the inventive modular insulating container.

According to a still further preferred embodiment of the invention pre-tempering is achieved by pre-cooling, said at least one temperature control element on the cover member perforated towards the inner volume being pre-cooled to colder than 2° C. and preferably below 0° C. The heat insulated panel perforated towards the inner volume allows the use of water based temperature control elements in the cover, without—due to its use—any undercooling below 2° C. of the goods in the inner volume of the inventive modular insulating container. Water based temperature control elements have the advantage of higher melt enthalpy with about 320 kJ/kg relative to common latent heat storage units for the range between 2 to 8° C.

BRIEF DESCRIPTION OF THE DRAWINGS

Further features, specifications and advantages of the invention are presented in the drawings and will be described below.

DETAILED DESCRIPTION

Figure 1:
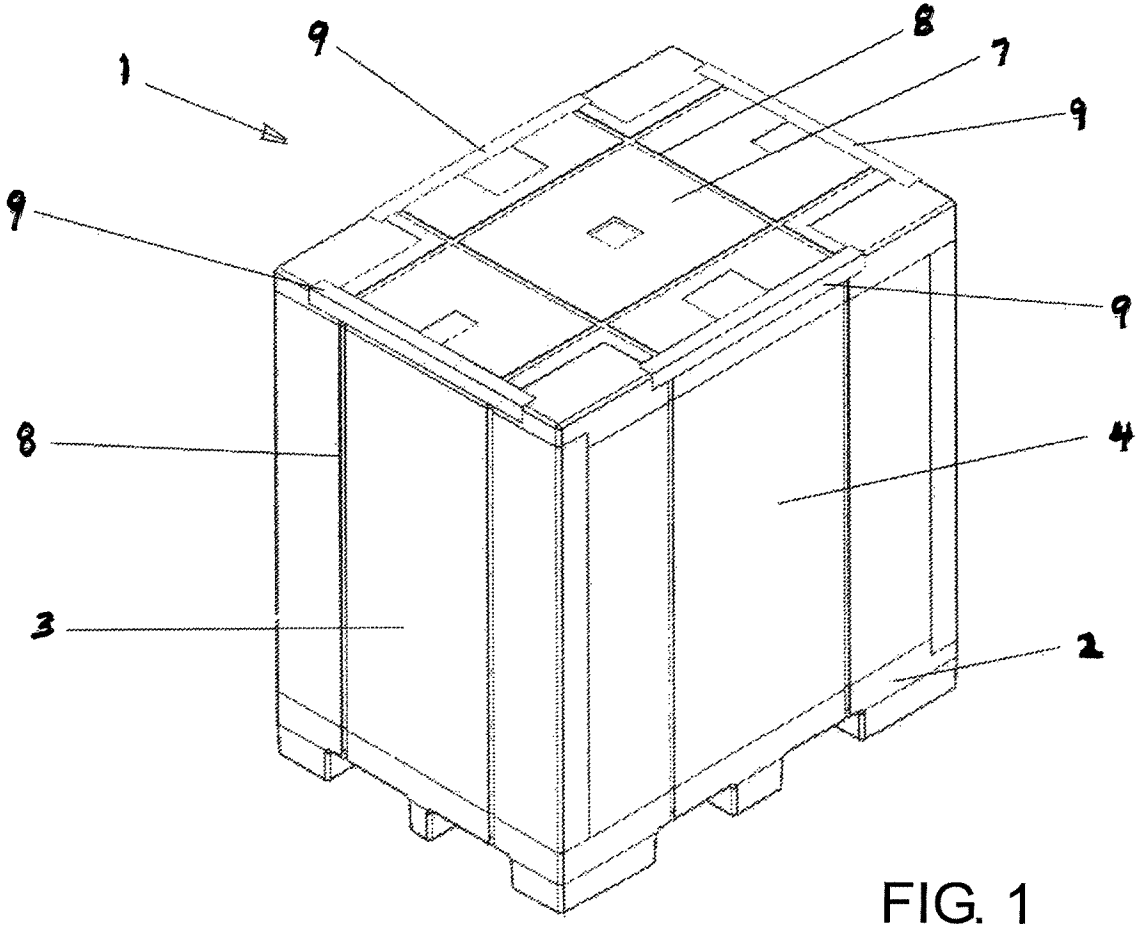
FIG. 1 shows a perspective total view of a modular insulated container according to the invention.
Figure 2:
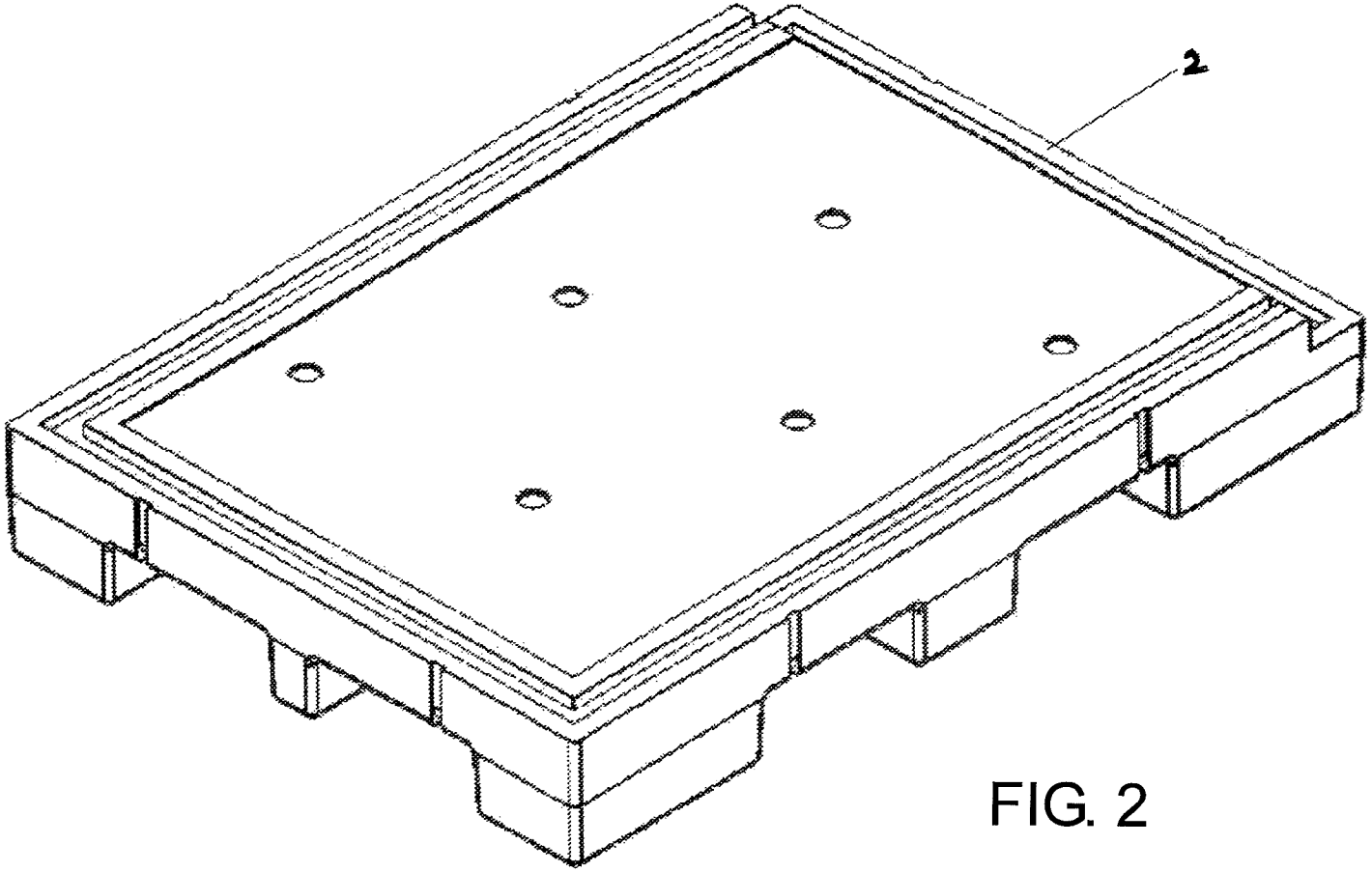
FIG. 2 shows a perspective view of a base of the modular insulated container according to the invention.
Figure 3:
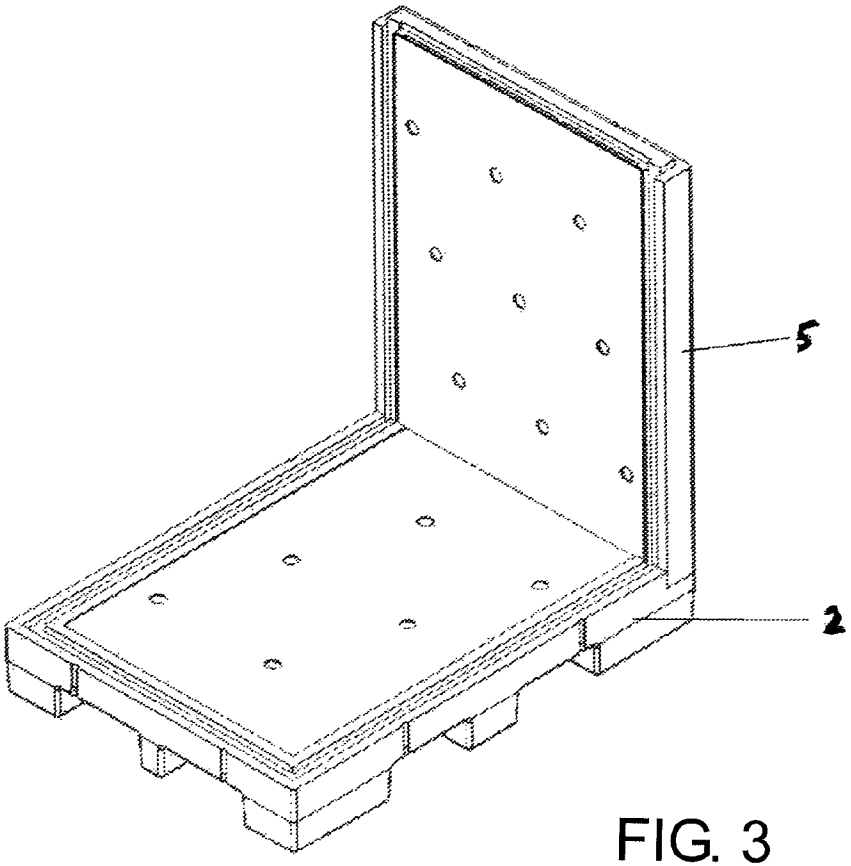
FIG. 3 shows a perspective view of the base with a side-wall of the modular insulated container according to the invention.

FIG. 1 shows a modular insulated container 1 with an inner volume with a rectangular layout for the distribution of drugs to be maintained at a temperature between 2 to 25° C. or 15 to 25° C. or 2 to 8° C.

Four respectively individually separable side walls 3-6 and a cover 7 are mounted on a base 2 of the inventive modular insulating container 1 and respectively for insulating effect towards the outside are provided with insulating material, such as expanded polystyrene or expanded polypropylene or polyurethane hard foam.

The modular insulating container 1 is adapted with the inner volume for storage of complete pallets with goods, e. g. Euro-pallets or US-pallets loaded with drug boxes. For sufficiently insulating effect towards the outside and for stability the base 2, the four respectively individually separable side walls 3-6 and the cover 7 are each between 60 and 200 mm thick. The modular insulating container 1 has outer dimensions with the maximal allowable height for air freight of less than 160 cm.

Figure 9:
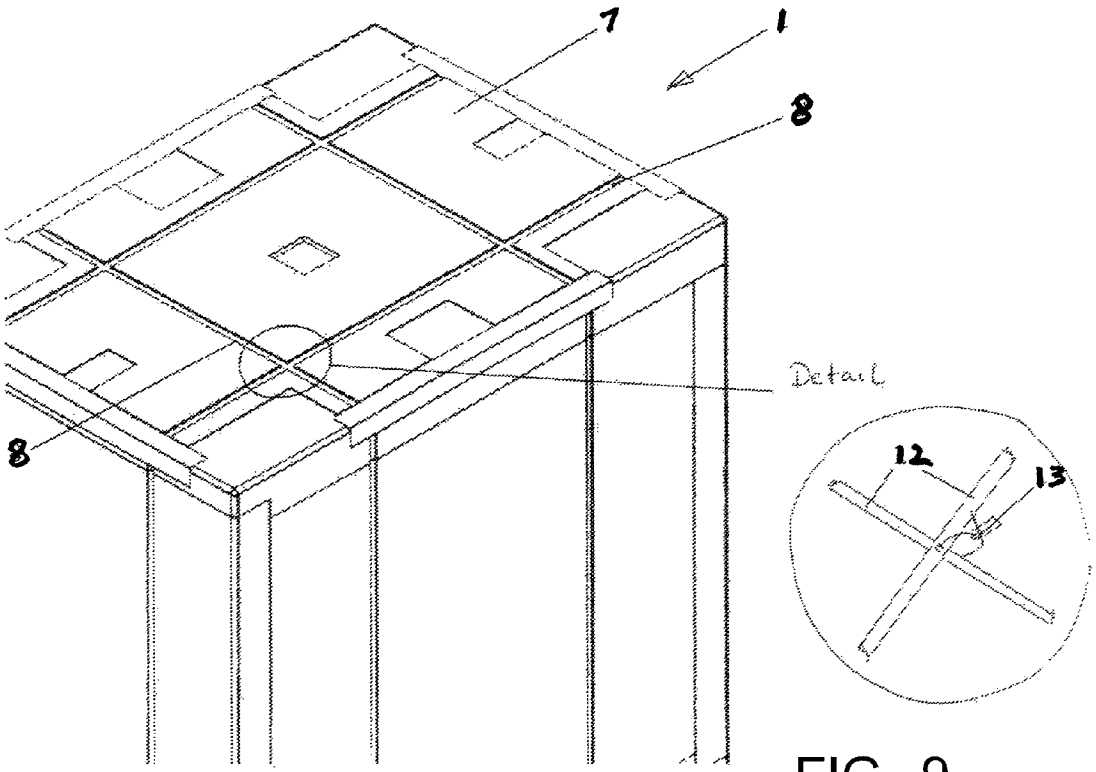
FIG. 9 shows a perspective sectional view of a modular insulated container with lead-sealing according to the invention.

The four respectively individually separable side walls 3-6 are rectangular and each provided with a tongue and groove system along its periphery for coupling each other and/or with the base 2 and/or the cover 7. The base 2 is shaped like a Euro-pallet. The outer surfaces of the separable side walls 3-6 and the cover 7 are provided with deepened grooves 8 for mounting of webbing load restraint assemblies. The deepened grooves 8 of the separable side walls 3-6 are respectively linked to deepened grooves 8 of the cover 7. Along top edges of the cover 7 the deepened grooves 8 are covered with rectangular edge protection 9 after accommodation of the webbing load restraint assemblies. The side walls 3-6 may as well be provided with lugs and may be sealed with cable seals (FIG. 9).

Figure 4:
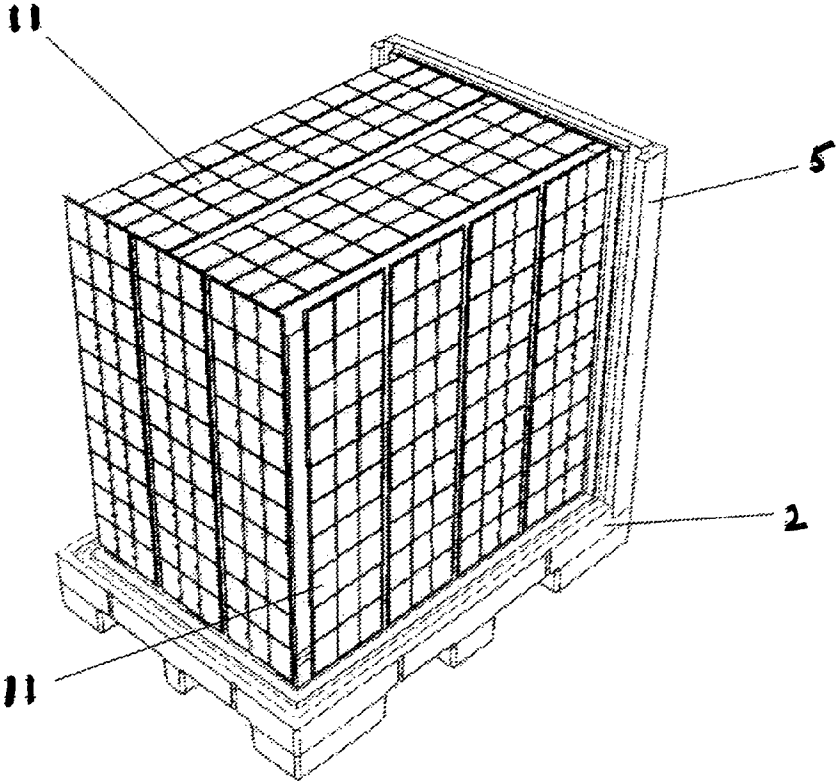
FIG. 4 shows a perspective view of the base with the side-wall of a loaded modular insulated container according to the invention.
Figure 5:
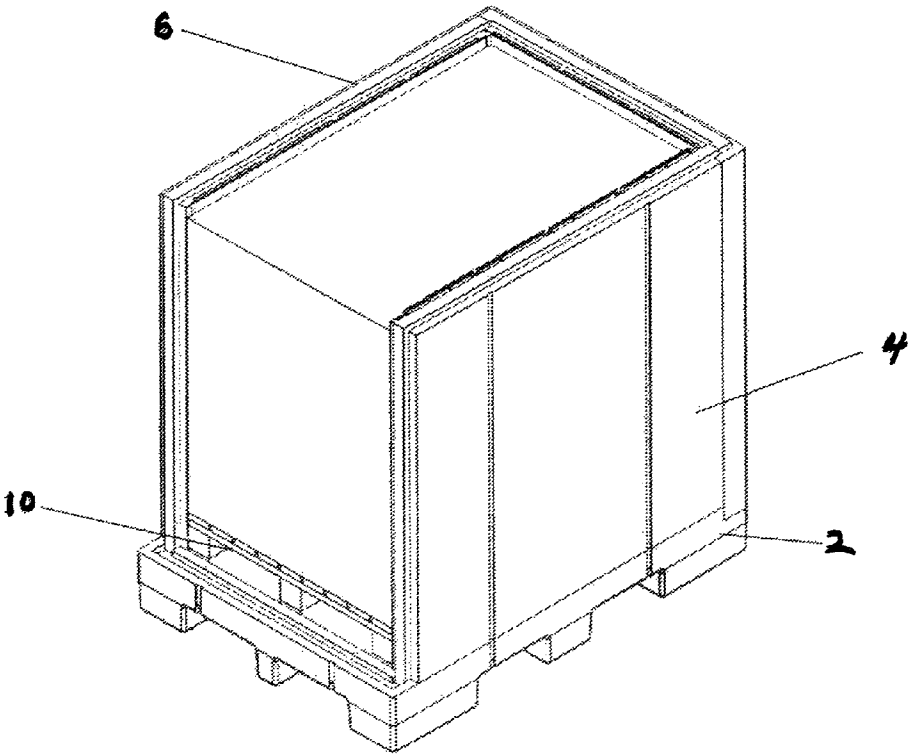
FIG. 5 shows a perspective view of the base with three side-walls of a "pallet loaded" modular insulated container according to the invention.
Figure 6:
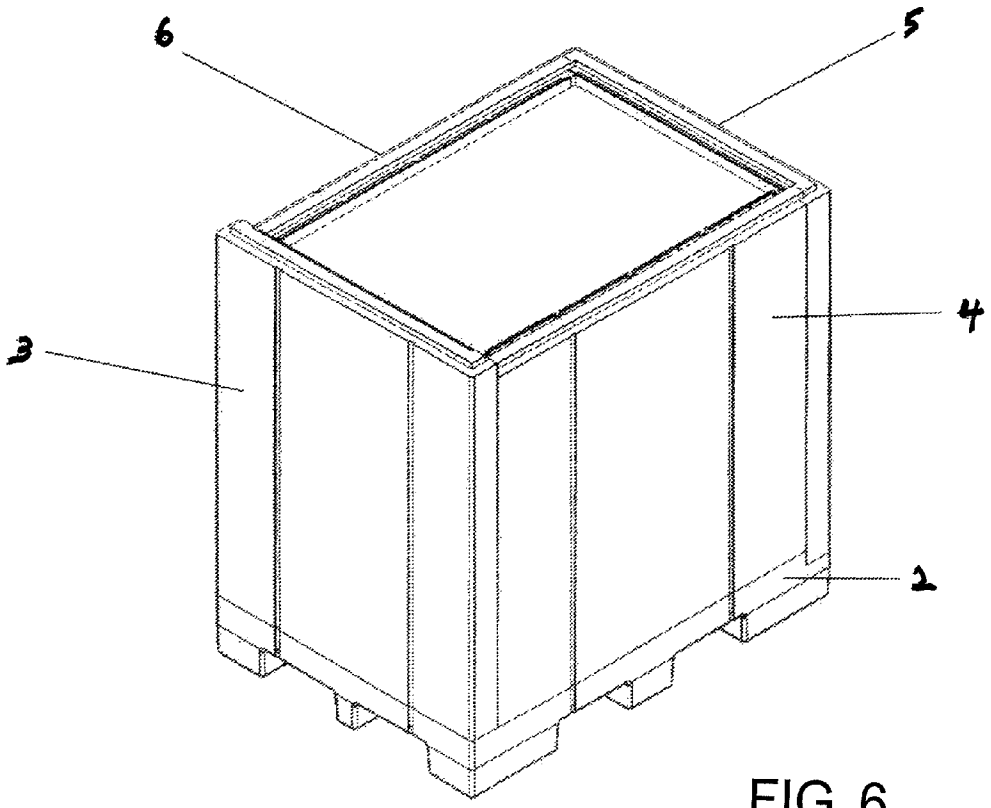
FIG. 6 shows a perspective view of the base with four side-walls of the loaded modular insulated container according to the invention.
Figure 7:
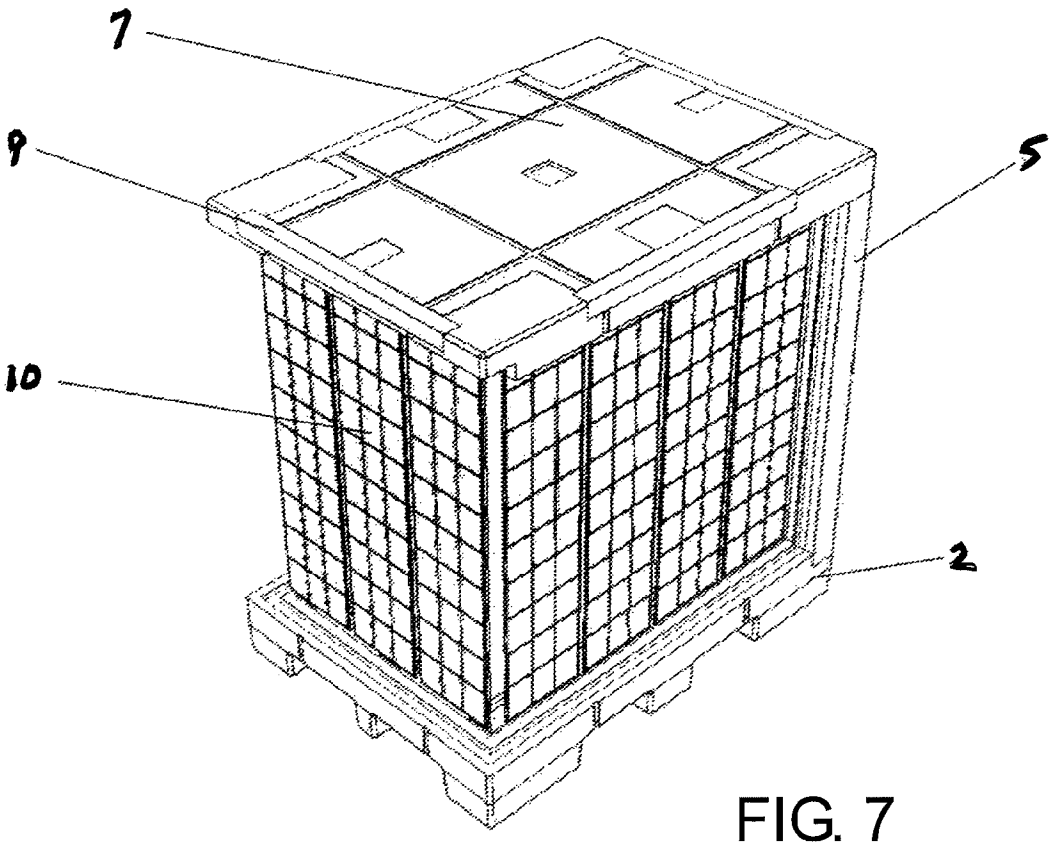
FIG. 7 shows a perspective total view of an along the side-walls cut free loaded modular insulated container according to the invention.
Figure 8:
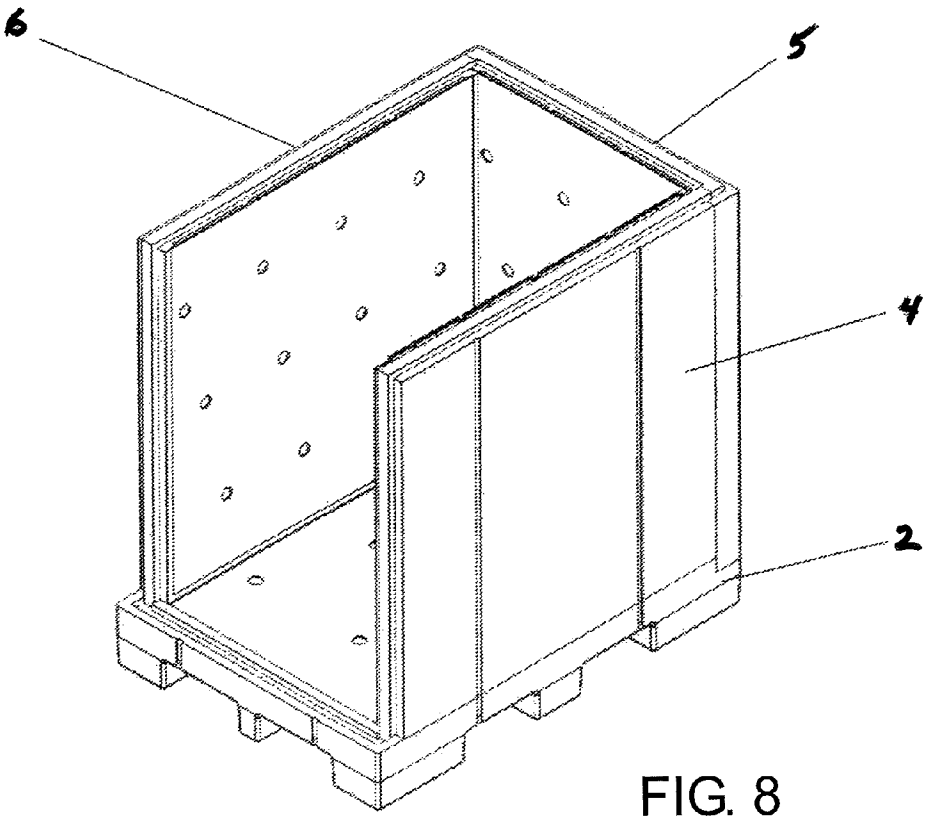
FIG. 8 shows a perspective view of the base and three side-walls of an unloaded modular insulated container according to the invention.

FIGS. 2-8: Corresponding features are referred to with the references of FIG. 1. First of all, before assembly of the modular insulated container 1, the base 2 with a Euro-pallet 10 is loaded with goods (s. FIG. 5). Subsequently the side walls 3-6 are mounted separately on the base 2 and are fixed together by means of its tongue and groove system (s. FIGS. 3, 5, 6, and 8) in order to avoid thermal bridges. Eventually the cover 7 is on top of the side walls 3-6 (s. FIG. 7). The inner volume mounted of the modular insulated container 1 has dimensions of 120 cm×80 cm×120 cm.

In at least one inner side of the insulating side walls 3-6 oriented to the inner volume mounted of the modular insulated container 1, of the base 2 and/or the cover 7 are provided thermal storage fluids in temperature control elements 11 (s. FIG. 4) with windows or made of transparent high barrier film. The thermal storage fluid serves as storage for thermal energy and is mounted on the inner sides for fast cold- or heat-exchange with the inner volume of the modular insulated container 1. The thermal storage fluid is preferably 1. pure n-paraffin, C16, C17 or C18, 2. n-paraffin mix of C16, C17 and/or C18, 3. pure tetradecan C14, 4. tetradecan/pentadecan mix of C14 and C15, 5. pure pentadecan, 6. n-paraffin mix of C10 to C18, 7. water, 8. saturated NaCl—salt solution, 9. saturated salt solution of ammonium hydrate or 10. 2,3-butandiol.

The thermal storage fluid is filled in the temperature control elements 11 as PET bags, particularly in aluminium coated PET bags or in PE plastic sheaths. The PET bags are adhered to the insulating side-walls 3-6, to the base 2 and/or to the cover 7 or fixed with connecting-type components. For higher stability and increased heat transfer to the inner volume the temperature control elements (not shown) integrated in at least one of the side-walls 3-6, the base 2 and/or the cover 7 are covered with corrugated cardboard (not shown) or PE-boards or aluminum boards or PE-film with high heat conductivity.

The PET bags 11 are flat between 1 mm and 30 mm and provide at least 60% coverage of the surface of the inner volume for possible evenly stable temperatures in the inner volume of the modular insulated container 1. 1 to 100 high barrier film bags are foreseen for each of the side-walls 3-6, the base 2 and/or the cover 7.

FIG. 9: Corresponding features are referred to with the references of FIGS. 1-8. Webbing load restraint assemblies 12 enclosing the modular insulated container 1 in the deepened grooves 8 are perforated at cross points and closed on the cover 7 by means of a numbered customs seal 13.

Figures 10, 11:
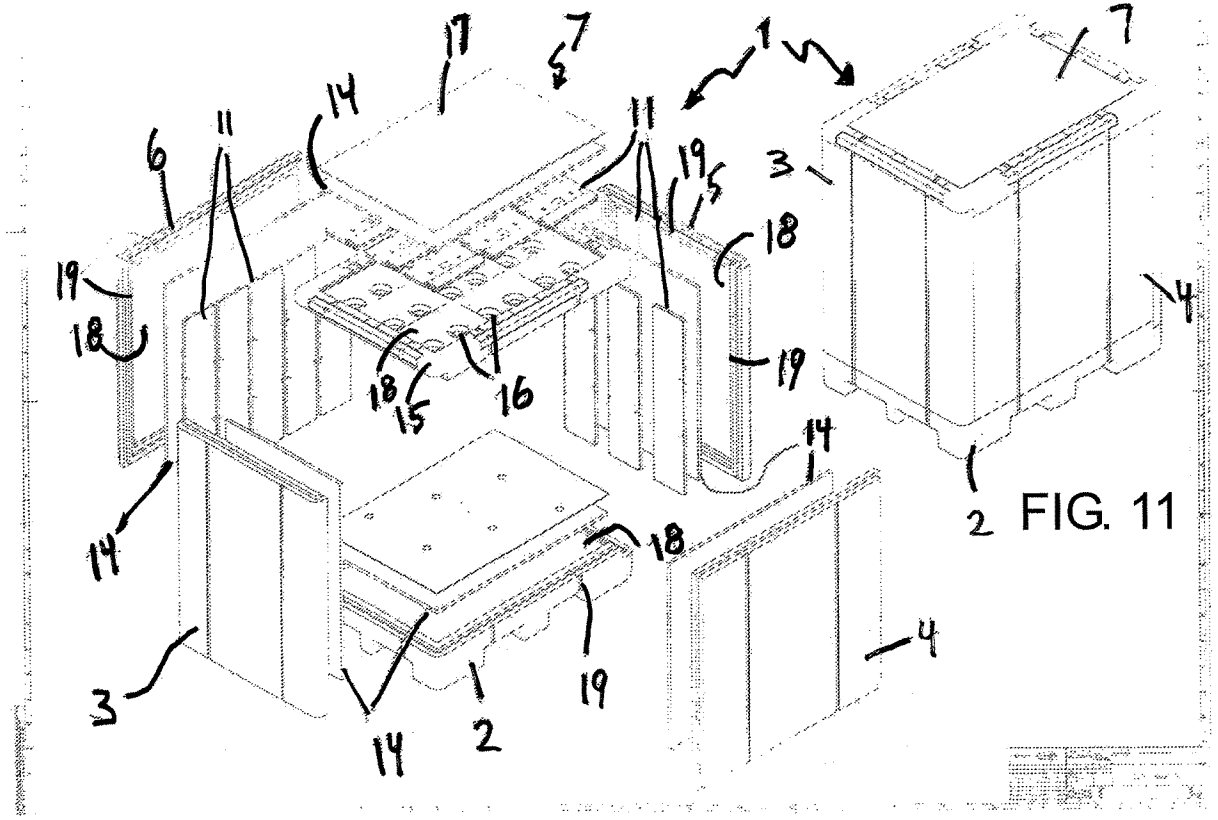
FIG. 10 shows a perspective exploded view of a further modular insulated container according to the invention.
FIG. 11 shows a perspective total view of the further modular insulated container according to the invention.

FIG. 10: Corresponding features are referred to with the references of FIGS. 1-9. The base 2 made of insulating material with a rectangular layout with its side oriented towards the inner volume of the modular insulated container 1 is provided with a rectangular cavity 18 for reception of a heat insulated panel 14. The heat insulated panel 14 extends substantially across the entire layout of the base 2 and has a heat conductivity of less than 0.02 W/(m×K). The base 2 may be conceived as underridable pallet.

The four respectively individually separable side-walls 3-6 made of insulating material with a rectangular layout with its side oriented towards the inner volume of the modular insulated container 1 are respectively provided with a rectangular cavity 18 for reception of the heat insulated panel 14.

The rectangular cavities 18 are respectively enclosed like in frames by fillets 19 oriented towards the inner volume, said fillets 19 being large between 5 and 50 mm parallel to the plane of the cavities 18 such that after assembly between base 2 and each of the at least four side-walls 3-6 the heat insulating panels 14 enclosed in the cavities 18 along the edges between base 2 and each of the at least four side-walls 3-6 have respectively a distance of at least 10 mm and at most 100 mm from each other for a thermally not entirely closed, fragmentary insulating body made of panels.

A perforated cover member 15 of the cover 7 with a rectangular layout and perforations 16 is provided with a rectangular cavity 18 on the side turned away from the inner volume of the modular insulated container 1 for reception of water based temperature control elements 11, colder than 2° C. and preferably pre-cooled to less than 0° C. and being in solid state. The perforations 16 are conceived towards the inner volume of the modular insulated container 1, such that no closed sheathing of the transported goods with insulation is effected.

The side walls 3-6 may be clipped reversibly with the base 2 by means of a clip system, particularly by means of a tongue and groove system in order to provide an inner volume insulated towards the outside. The dimensions of the inner volume are such that temperature control elements 11, so called latent heat-storage units may be positioned inside of all four side-walls 3-6.

Water based temperature control elements 11 or latent heat-storage units are provided in the inner volume having their fluid melt-point next to the stipulated product temperature, with in case of 2 to 8° C. water based temperature control elements 11 possibly in combination with 2 to 6° C. latent heat-storage units inserted in the inner volume in the cover 7 and 2 to 6° C. latent heat-storage units inserted in the inner volume at the side-walls. Supplemental temperature control elements 11 can be inserted between the pallets of the transported goods and the goods to be tempered.

These temperature control elements 11 consist of a plastic sheathing filled with thermal storage fluid, said temperature control elements 11 as so called accu boards being individually or in numbers packed together in supplemental film, preferably welded transparent film or hose bag film for faster loading of the modular insulated container 1. The supplemental film or hose bag film as heat conductive material separates with a thickness of 5-150 μm the thermal storage fluids from the inner volume. The temperature control elements 11 are alternatively wrapped into card- or plastic-boxes with windows or exemptions, to allow visual recognition of correct pre-cooling by means of the aggregate state of the thermal storage fluid.

The cover 7 is as well reversible connectable by means of a tongue and groove system with the four vertically standing side-walls 3-6. The at least one cavity 18 in the cover member 15 with the therein inserted temperature control elements 11 is covered to the outside with a heat insulating panel 14. A protective layer 17 as well connected with the cover member is laid on top of the heat insulating panel 14 towards the outside.

For the assembly of the modular insulating container 1 first of all the perforated cover member 15 is mounted on the side-walls 3-6. Subsequently the pre-tempered elements 11 are implemented in the cavity 18 of the perforated cover member 15 and eventually the heat insulating panel 14 and the protective layer 17 are mounted.

The peripheral edges of the side-walls 3-6 of the modular insulating container 1 are provided with cut-outs for the provision of edge protection. The peripheral parts respectively have at least one recess for a webbing load restraint assembly for safe closure and sealing of the entirely packed modular insulated container 1. Sealing may be achieved by means of e. g. a seal pulled through the webbing load restraint. Corners and edges of the modular insulated container 1 are rounded in order to introduce mechanic forces more evenly into the material of the side-walls 3-6 and thus to increase stability.

Method of pre-tempering of the side-walls 3-6, of the base 2 and/or of the cover 7

The pre-tempering of the separate side-walls 3-6, of the base 2 and/or of the cover 7 is already achieved due to the high heat conductivity of the temperature control element 11 at 1° C. to 2° C. below the solidifying temperature of the thermal storage fluid, i. e. for a thermal storage fluid with a melting-point between 20 and 22° C. pre-cooling temperatures of 2 to 18° C. are sufficient. The pre-cooling of the temperature control element 11 is effected till solidification of the thermal storage fluid occurs and thus its optimal storage energy is achieved. The time needed for pre-cooling depends on temperature difference and air convection at the surface of temperature control element 11 and may last a few hours till up to a couple of days according to the configuration.

After pre-cooling the separate side-walls 3-6, the base 2 and/or the cover 7 act themselves as thermal storage transferring rapidly on their inner side their thermal storage energy to the inner volume of the temperature control element 11 and being insulated towards the outside.

The inner sides of the separate side-walls 3-6, of the base 2 and/or of the cover 7 should be circulated freely by the ambient air transferring heat or cold for the pre-tempering, thus providing an as possible fast heat exchange.

The pre-tempering of the side-walls 3-6, of the base 2 and/or of the cover 7 may already be achieved during delivery in a thermo-trailer or a lorry-trailer (not shown) with active cooling means. Therefore the temperature control elements 11 are wrapped and loaded to the separate side-walls 3-6, of the base 2 and/or of the cover 7 in a way that the circulating cold air of the thermo-trailer thermally charges the integrated thermal storage fluid and subsequently the temperature control elements 11 can be used directly without any need for further pre-tempering of the side-walls by means of integrated thermal storages or for example not integrated cooling element. If the respective temperature control element 11 is operable can be checked visually through windows on the inner sides of the side-walls 3-6, of the base 2 and/or of the cover 7.

I claim:

1. A modular insulated container with an inner volume for storing goods at constant temperatures, said modular insulated container comprising;

a base, a cover and at least four side walls which enclose the inner volume and each of the base, the top and the side walls being provided with a heat insulating structure wherein the at least four side walls are each mounted separately with the base and the cover, and at least one of the side walls has a temperature control element, which faces the inner volume and contains a thermal storage fluid, wherein the temperature control element is separated from the inner volume by a thermally conductive material consisting of a transparent barrier film made of one of PET, PE and polyamide (PA) and with a further barrier layer of at least one of ethylenevinyl-alcohol (EVOH), a polyester with a barrier of at least one of PET coated with polyvinylidenchloride ((PETX)(PVDC)), oriented polypropylene with a barrier (OPPX or "BOPP"), polyester with a barrier (PETXP), PAX, polyamide/EVOH (barrier)/polyamide (PA-EVOH-PA) and oriented polyimide (OPA), and wherein the container is provided with a detector and a recorder for recording temperature, pressure and vibration values detected by the detector.

2. The container according to claim 1, wherein the insulating material comprises expanded polystyrene, expanded polypropylene or polyurethane hard foam.

3. The container according to claim 1, wherein the side-walls are between 60 and 200 mm thick.

4. The container according to claim 3, wherein the side walls are rectangular and are provided along peripheries thereof, respectively, with a tongue or groove.

5. The container according to claim 1, wherein the at least one base is shaped like a pallet.

6. The container according to claim 1, wherein the thermally conductive material is 5 to 150 micrometer thick.

7. The container according to claim 1, wherein the barrier film is in the form of a transparent barrier film bag.

8. The container according to claim 7, wherein the PET barrier film bag is aluminum coated or provided with polyethylene plastic sheets which are attached to the at least four side-walls, the base and the cover.

9. The container according to claim 7, wherein the PET high barrier film bag is flat, between 1 mm and 30 mm thick, and provides at least 60% surface coverage of the inner volume.

10. The container according to claim 1, wherein up to 1000 high barrier film bags are provided on each side-wall.

11. The container according to claim 1, wherein the thermal storage fluid comprises pure n-paraffin with a chain-length of C16, C17, C18, pure tetradecan C14, tetradecan/pentadecan mix of C14 and C15, pure pentadecan, n-paraffin mix of C10 to C18, water, eutectic salt solutions, salt mixes, saturated salt solution of ammonium hydrate or 2,3-butandiol.

12. The container according to claim 1, wherein the temperature control element is covered with a corrugated card board, PE-board aluminum board or PE-film.

13. The container according to claim 1, wherein the detector and recorder are liquid crystal thermometer and a temperature data logger, respectively.

14. The container according to claim 13, wherein the detector and recorder are provided with a transmitter for detected and recorded data.

15. The container according to claim 1 further comprising;

heat insulating panels arranged respectively at a side oriented towards an inside of the base and the at least four sidewalls and in the cover, and a cover member perforated towards the inner volume with at least one cavity and at least one temperature control element is provided between this cover member and one of the heat insulating panels which is located in the cover.

16. The container according to claim 15, wherein cavities are provided for storing the heat insulating panels respectively at the side oriented towards the inside of the at least one base and the at least four Side walls.

17. The container according to claim 15, wherein the at least one heat insulating panel above the at least one temperature control element towards the inner volume perforated cover member is provided with a protection layer, which is laid on the at least one heat insulating panel above temperature control element on the cover member.

18. The container according to claim 11, wherein the at least one temperature control element on the cover member is water-based.

19. The container according to claim 7, wherein the temperature control element is welded to one of the metal coated transparent film and the barrier film bag.

* * * * *